US005775306A

United States Patent [19]

Wood

[11] Patent Number: 5,775,306

[45] Date of Patent: Jul. 7, 1998

[54] ADVANCE MECHANISM

[75] Inventor: Christopher Wood, Aylesford, England

[73] Assignee: Lucas Industries plc, England

[21] Appl. No.: 770,855

[22] Filed: Dec. 20, 1996

Related U.S. Application Data

[63] Continuation of Ser. No. 500,439, Jul. 10, 1995, abandoned.

[30] Foreign Application Priority Data

Jul. 15, 1994 [GB] United Kingdom ..... 9414308

[51] Int. Cl.[6] ..... F02M 37/04

[52] U.S. Cl. ..... 123/502; 92/181 R; 92/127; 417/219

[58] Field of Search ..... 123/502, 450; 92/181 R, 127, 138; 417/219, 218

[56] References Cited

U.S. PATENT DOCUMENTS

| | | | |
|---|---|---|---|
| 3,394,688 | 7/1968 | Roosa | 123/502 |
| 3,552,366 | 1/1971 | Kemp | 123/502 |
| 3,897,764 | 8/1975 | Bakti | 123/502 |
| 4,100,903 | 7/1978 | Roosa | 417/273 |
| 4,526,154 | 7/1985 | DiDomenico | 123/502 |
| 4,545,738 | 10/1985 | Young | 92/127 |
| 4,589,394 | 5/1986 | Ito | 123/502 |
| 4,753,211 | 6/1988 | Hofer | 123/502 |
| 4,798,189 | 1/1989 | Thornthwaite et al. | 123/502 |
| 5,201,297 | 4/1993 | Eblen et al. | 123/502 |

FOREIGN PATENT DOCUMENTS

| | | | |
|---|---|---|---|
| 0032019 | 2/1982 | Japan | 123/502 |
| 0032928 | 2/1983 | Japan | 123/502 |

*Primary Examiner*—Timothy Thorpe
*Assistant Examiner*—Peter G. Korytnyk
*Attorney, Agent, or Firm*—Andrus, Sceales, Starke & Sawall

[57] ABSTRACT

An advance mechanism for a pump comprises a fluid operable piston arranged to have pressurized fluid applied to a first end thereof to adjust the axial position of the piston. The arrangement further comprises means for applying fluid under pressure to a part of the piston remote from the first end thereof in order to apply a torque to the piston. In one embodiment, the means for applying comprises a passage extending within the piston, the passage communicating with the first end of the piston such that high pressure fluid is received by the passage.

8 Claims, 2 Drawing Sheets

FIG.2.
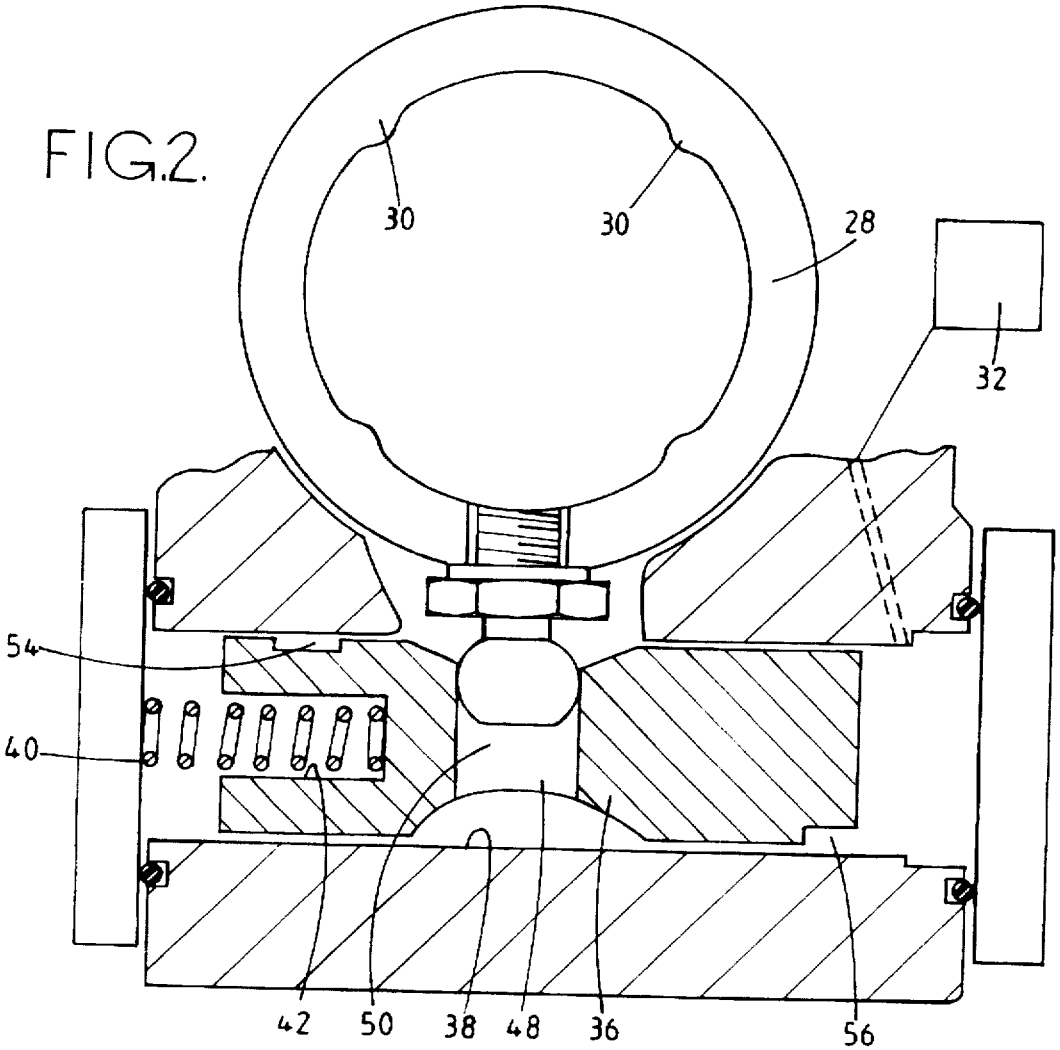
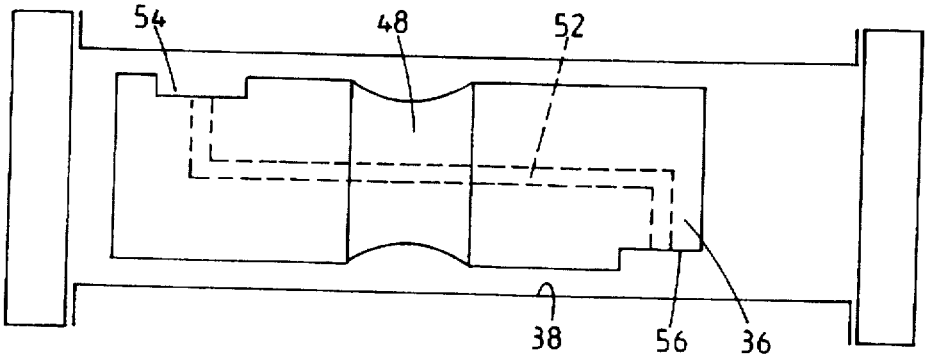
FIG.3.

ADVANCE MECHANISM

This is a continuation of application Ser. No. 08/500.439, filed Jul. 10, 1995, now abandoned.

This invention relates to an advance mechanism for a distributor pump apparatus.

BACKGROUND OF THE INVENTION

A known distributor pump apparatus comprises a distributor member rotatable within a sleeve in timed relation with an associated engine, the distributor member including inlet and outlet passages arranged to align, in turn, with associated inlet and delivery ports provided in the sleeve on rotation of the distributor member. An end region of the distributor member is provided with a plurality of radially extending bores within which corresponding plungers are reciprocable, the bores communicating with the inlet and outlet passages. The outer end of each plunger is provided with a shoe carrying a roller arranged to engage with the inner surface of a cam ring provided with a plurality of cam lobes.

In use, when one of the inlet passages aligns with the inlet port, fuel enters the distributor member and enters the bores, pushing the associated plungers outwards. Rotation of the distributor member results in the communication of the inlet passage with the inlet port being broken, further rotation resulting in the outlet passage aligning with one of the associated delivery ports and with the rollers coming into contact with the cam lobes, pushing the plungers inward and pumping fuel from the distributor member to a cylinder of the associated engine through the outlet port.

A rotor of a feed pump is provided at the opposite end of the distributor member. The inlet and outlet of the feed pump are interconnected by a relief valve and since the feed pump operates at the speed of the distributor member, the pressure of fuel at the outlet of the feed pump is dependent upon the speed of the engine.

In order to adjust the timing at which fuel is supplied to the cylinders of the engine, the cam ring is angularly adjustable, the distributor pump apparatus further comprising a fluid operated advance piston arranged to engage with a peg provided on the cam ring. Fuel from the feed pump is applied to an end of the piston and the movement of the piston under the action of the fuel pressure is opposed by a helical spring. The piston therefore assumes a position which is related to the engine speed. As the engine speed increases, the piston moves to advance the timing at which fuel is delivered to the cylinders of the engine. On reducing engine speed, the fuel pressure applied to the piston is reduced, the piston moving under the action of the spring to retard the timing of fuel delivery to the engine.

The position at which the peg engages with the piston is not on the centre line of the piston, the engagement of the peg with the piston resulting in the application of a torque to the piston tilting the piston. This effect is of particular significance when the rollers of the plungers contact the cam lobes, tending to move the cam ring in the same direction as the distributor member, pushing the advance piston to compress the fuel applied to the high pressure end thereof. In order to prevent substantial movement of the cam ring under such circumstances, the apparatus is arranged to create a temporary hydraulic lock to substantially prevent the escape of fuel from the high pressure end of the piston. Since the force applied to the piston is not along the centre line of the piston, a large torque is applied thereto causing the piston to tilt. Such tilting results in increased wear and in poor lubrication of the piston.

SUMMARY OF THE INVENTION

According to the present invention there is provided an advance mechanism comprising a fluid operable piston including a first end arranged to have pressurized fluid applied thereto to adjust the axial position of the piston, and means for applying fluid under pressure to a part of the piston remote from the first end thereof in order to apply a torque to the piston.

The advance mechanism preferably further comprises means for applying fluid under pressure to part of the piston adjacent the first end in order to apply a torque to the piston.

The application of fluid under pressure to the piston is such that a torque opposing that resulting from the engagement of the peg with the piston is applied thereto, thereby reducing the tilting movement of the piston and hence reducing the disadvantages associated with such tilting.

The fluid under pressure applied to the piston to apply a torque thereto is preferably fuel supplied to the piston from a feed pump of a distributor pump apparatus the outlet pressure of which is dependent upon the speed of an associated engine.

BRIEF DESCRIPTION OF THE DRAWINGS

The invention will further be describe, by way of example, with reference to the accompanying drawings, in which:

FIG. 2 is a cross sectional view of part of the distributor pump apparatus of FIG. 1; and FIG. 3 is a diagrammatic view of the advance piston of the apparatus of FIGS. 1 and 2.

DESCRIPTION OF THE PREFERRED EMBODIMENTS

Figure 1:
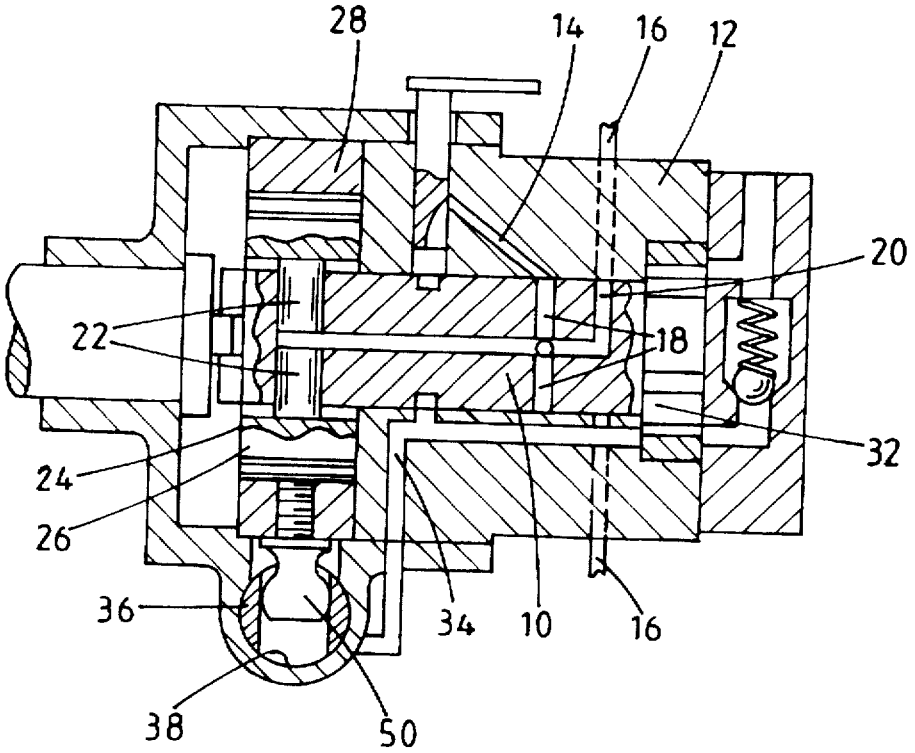
FIG. 1 is a cross sectional view of a distributor pump apparatus.

The distributor pump apparatus illustrated in FIGS. 1 and 2 comprises a cylindrical distributor member 10 rotatable within a sleeve 12 in timed relation with an associated engine. The sleeve 12 is provided with an inlet port 14 communicating with a suitable fuel supply, and a plurality of delivery ports 16 (dotted lines in FIG. 1) each communicating with a respective cylinder of the associated engine. The distributor member 10 includes a plurality of inlet passages 18 arranged to align, in turn, with the inlet port 14 as the distributor member 10 rotates, and a delivery passage 20 arranged to register with the delivery ports 16 on rotation of the distributor member 10.

An end of the distributor member 10 is provided with a plurality of radially extending bores, each communicating with the inlet and delivery passages 18, 20. A plunger 22 is provided in each bore, each plunger 22 being provided, at its outer end, with a shoe 24 carrying a roller 26. The rollers 26 are arranged to engage with the inner surface of an angularly adjustable cam ring 28 provided with a plurality of cam lobes 30 such that in use, starting from the position illustrated in FIG. 1, fuel is delivered from the inlet port 14 to the bores, the fuel pushing the plungers 22 outwards. Rotation of the distributor member 10 results in the communication between the inlet port 14 and the corresponding inlet passage 18 being broken. Further rotation results in the delivery passage 20 aligning with one of the delivery ports 16, and shortly afterwards, in the rollers 26 contacting the cam lobes 30 of the cam ring 28. Continued rotation results in the plungers 22 being pushed inwardly due to the engagement of the rollers 26 with the cam lobes 30, ejecting the fuel from the bores, and pumping fuel through the delivery passage 20 to the associated delivery port 16 and thence to the associated cylinder of the engine. Further rotation results in the communication between the delivery passage 20 and the delivery port 16 being broken, and in the rollers 26 disengaging with the cam lobes 30, the cycle repeating on the next inlet passage 18 aligning with the inlet port 14 of the sleeve 12.

A feed pump 32 is provided at the end of the distributor member 10 remote from the bores, the rotor of the pump 32 being carried by the distributor member 10 so that it rotates in timed relation with the engine. The feed pump 32 is arranged to supply fuel through a passage 34 to a fluid pressure operated advance piston 36 which is provided in a suitable bore 38 in distributor pump apparatus housing. The high pressure end 36B of the piston and the bore form a high pressure chamber 36A. The piston slides on a longitudinal axis within the bore. In addition, fuel is supplied to the inlet port 14 by way of a fuel control device.

The advance piston 36 is spring biased to the right as shown in FIG. 2 by a helical spring 40 arranged to engage in a recess 42 provided in one end of the piston 36. A diametrically extending bore 48 is provided in the advance piston 36, the bore 48 being arranged to receive a peg 50 provided on the external surface of the cam ring 28.

In use, when the engine operates at high speed, the outlet pressure of the feed pump 32, and hence the pressure of the fuel applied to the high pressure end 36B of the piston 36 is relatively high, pushing the piston 36 to the left as shown in FIG. 2. Such movement has the effect of pushing the peg 50, and hence the cam ring 28 in a clockwise direction which, due to the anticlockwise rotation of the distributor member 10, advances the timing at which fuel is delivered to the associated engine.

On reducing engine speed, the fuel pressure applied to the piston 36 is reduced and the piston 36 moves towards the right as shown in FIG. 2 under the action of the spring 40, such movement resulting in anticlockwise movement of the cam ring 28 retarding the timing of fuel delivery to the engine.

As is clear from FIG. 2, the peg 50 engages with the advance piston 36 at a position offset from the centre line of the piston 36. The reaction force resulting from movement of the piston 36 tends to tilt the piston in a clockwise direction. Of greater significance is the tilting movement occurring as a result of the rollers 26 engaging with the cam lobes 30 tending to move the cam ring 28 in an anticlockwise direction. As described before, the torque applied to the piston 36 in such circumstances is large tending to cause the piston 36 to tilt.

In order to counter such a force, a passage 52 as shown in FIG. 3 is provided in the piston 36 carrying fuel from the high pressure end 36B of the piston 36 to a port 54 provided on the upper surface of the piston 36 adjacent the opposite end 36C thereof. High pressure fuel from the high pressure end of the piston 36 is applied to the inner surface of the bore 38, pushing the part of the piston 36 including the port 54 in a downwards direction. A recess 56 is also provided in the lower surface of the high pressure end 36B of the piston 36 arranged so that the fuel applies a force to the piston 36 tending to move that end of the piston 36 upwards. It will be recognised that the upwards movement of the high pressure end of the piston 36, and the downward movement of the other end of the piston 36 both counter the clockwise torque applied to the piston 36 by the peg 50, reducing the effect of such a torque.

It will further be noted that the pressure exerted at the port 54 and recess 56 is related to the pressure of fuel at the high pressure end of the piston 36, which in turn is related to the magnitude of the force applied to the piston 36 by the peg 50.

The passage 52 is illustrated diagrammatically in FIG. 3 and may be provided at any suitable location within the piston 36, not necessarily in the position shown. It will further be recognised that the passage 52 could be provided externally of the piston 36, arranged to apply pressure to part of the piston 36 remote from the high pressure end thereof.

I claim:

1. An advance mechanism for use with a fuel pump including an angularly adjustable cam arrangement adjustable under the influence of the advance mechanism, the advance mechanism comprising a piston slidable on a longitudinal axis within a bore, said piston having an operative connection to said cam arrangement which, in use, imposes a reaction torque on said piston tending to rotate said piston in a plane through an axis of piston movement, the piston including a high pressure end surface which defines, with the bore, a high pressure chamber to which pressurized fuel is applied to adjust the axial position of the piston with respect to the bore, and means for applying fuel to a part of the piston remote from the high pressure end surface thereof to apply a counter torque to the piston in said plane to counter said reaction torque.

2. A mechanism as claimed in claim 1, further comprising means for applying fluid under pressure to part of the piston adjacent the first end in order to apply a torque to the piston.

3. A mechanism as claimed in claim 2, wherein the means for applying fluid under pressure to part of the piston adjacent the high pressure end comprises a recess provided in the piston adjacent the high pressure end thereof, the recess being arranged to communicate with the high pressure end of the piston to receive fluid under pressure therefrom.

4. A mechanism as claimed in claim 1, wherein the means for applying fluid under pressure to the part of the piston remote from the high pressure end thereof comprises a passage arranged to communicate with the pressurized fluid applied to the high pressure end of the piston, the passage extending to a position remote from the high pressure end of the piston.

5. A mechanism as claimed in claim 4, wherein the passage extends within the piston.

6. A mechanism as claimed in claim 1, wherein the fluid under pressure applied to the piston to apply a torque thereto is supplied to the piston from a feed pump of a distributor pump apparatus the outlet pressure of which is dependent upon the speed of an associated engine.

7. A fuel pump comprising an angularly adjustable cam arrangement, and an advance mechanism as claimed in claim 1, the cam arrangement being adjustable under the influence of the advance mechanism.

8. An advance mechanism comprising a piston slidable within a bore, the piston including a high pressure end which defines, with the bore, a high pressure chamber to which pressurized fuel is applied, in use, to adjust the axial position of the piston, the application of pressurized fuel imposing a reaction torque on said piston tending to rotate the piston in a plane through an axis of piston movement, a port provided on the upper surface of the piston opposite the high pressure end thereof, and a passage within the piston arranged to provide communication between the pressurized fuel applied to the high pressure end of the piston and the port to apply a counter torque to the piston in said plane to counter said reaction torque.

* * * * *